US006910920B2

(12) United States Patent
Su

(10) Patent No.: US 6,910,920 B2
(45) Date of Patent: Jun. 28, 2005

(54) STRUCTURE FOR ENGAGING BLADES WITH AN INNER FRAME OF A PLUG

(75) Inventor: Tun-Li Su, Kaohsiung Hsien (TW)

(73) Assignee: Gem Terminal Ind. Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/653,979

(22) Filed: Sep. 4, 2003

(65) Prior Publication Data

US 2005/0054239 A1 Mar. 10, 2005

(51) Int. Cl.[7] ..... H01R 13/58

(52) U.S. Cl. ..... 439/606; 439/595; 439/106

(58) Field of Search ..... 439/606, 595, 439/722, 693, 736, 604, 106, 752, 744, 871

(56) References Cited

U.S. PATENT DOCUMENTS 5,474,459 A * 12/1995 Su ..... 439/106
5,641,311 A * 6/1997 Chuang ..... 439/693
6,168,443 B1 * 1/2001 Mullen et al. ..... 439/606

* cited by examiner

*Primary Examiner*—P. Austin Bradley
*Assistant Examiner*—Felix O. Figueroa
(74) *Attorney, Agent, or Firm*—Rosenberg, Klein & Lee

(57) ABSTRACT

A combination of an inner frame and at least two blades for a plug is provided. The combination includes an inner frame and at least two blades. The inner frame includes at least two positioning holes and at least two hook members respectively located adjacent to the positioning holes. Each blade extends through an associated one of the positioning holes of the inner frame. Each blade includes a portion engaged with an associated one of the hook members, thereby retaining the blades in the inner frame during formation of a housing of a plug by injection molding.

10 Claims, 14 Drawing Sheets

STRUCTURE FOR ENGAGING BLADES WITH AN INNER FRAME OF A PLUG

BACKGROUND OF THE INVENTION

1. Field of the Invention

The present invention relates to a structure for engaging blades with an inner frame of a plug.

2. Description of the Related Art

A typical plug includes two or three blades. In manufacture, an end of a wire is placed into a wire-receiving groove in an end of a respective blade. The end of the respective blade is then pressed to securely clamp the end of the wire. Referring to FIG. 1 of the drawings, after the clamping procedure, the blades 1 are disposed in an inner frame 12 which is then placed into a mold for forming a housing of the plug by means of injection molding. However, it was found that the blades 1 could not be reliably positioned in the inner frame 12 during the injection molding procedure such that disqualified products were produced frequently. Further, undesired contact between the blades 1 extending through holes (not labeled) of the inner frame 12 occurred easily. As a result, a short circuit was apt to occur when the blades 1 were in a conductive state.

SUMMARY OF THE INVENTION

An object of the present invention is to provide a structure for engaging blades with an inner frame of a plug, thereby securely positioning the blades during an injection molding procedure for forming a housing of the plug.

In accordance with an aspect of the invention, a combination of an inner frame and at least two blades for a plug is provided. The combination includes an inner frame and at least two blades. The inner frame includes at least two positioning holes and at least two hook members respectively located adjacent to the positioning holes. Each blade extends through an associated one of the positioning holes of the inner frame. Each blade includes a portion engaged with an associated one of the hook members, thereby retaining the blades in the inner frame during formation of a housing of a plug by injection molding.

In an embodiment of the invention, the blades include a positive blade and a negative blade. Each blade includes an insulating layer formed on a rear section thereof. The insulating layer includes a flange that is engaged with the associated one of the hook members.

In another embodiment, the blades further include a grounding blade having an engaging hole for engaging with an associated one of the hook members.

In a further embodiment, the insulating layer of each blade includes a protruded portion, thereby forming a recessed portion on an outer side of the inner frame. The inner frame includes a plurality of through-holes extending through a bottom wall of the recessed portion and thus communicating with the recessed portion. Molten plastic material for forming the housing of the plug fills the recessed portion via the through-holes, thereby improving the bonding strength of the housing and the inner frame. Preferably, the through-holes include two rectangular through-holes.

A separation wall is formed between two positioning holes to eliminate the risk of short circuit resulting from a contact between the blades when in a conductive state.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
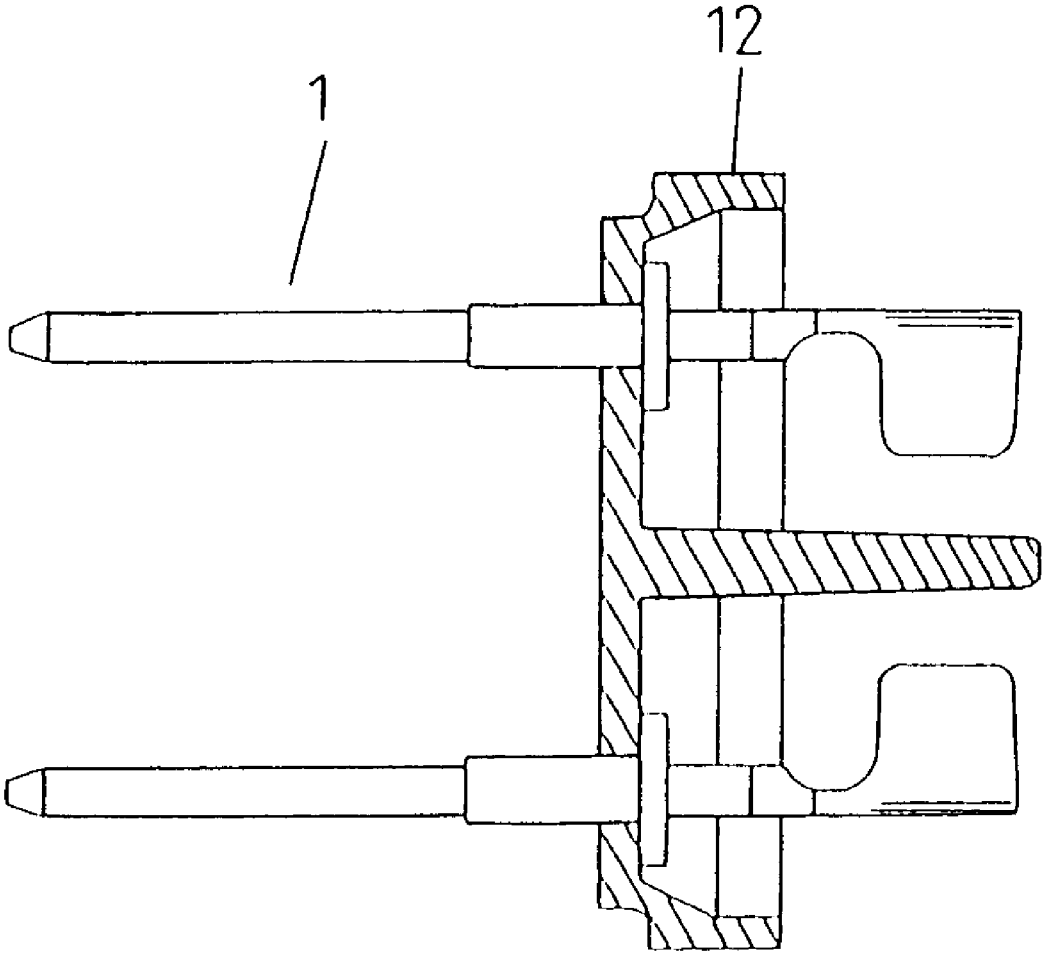
FIG.1 PRIOR ART
FIG. 1 is a sectional view of two blades and an inner frame of a conventional plug.
Figure 2:
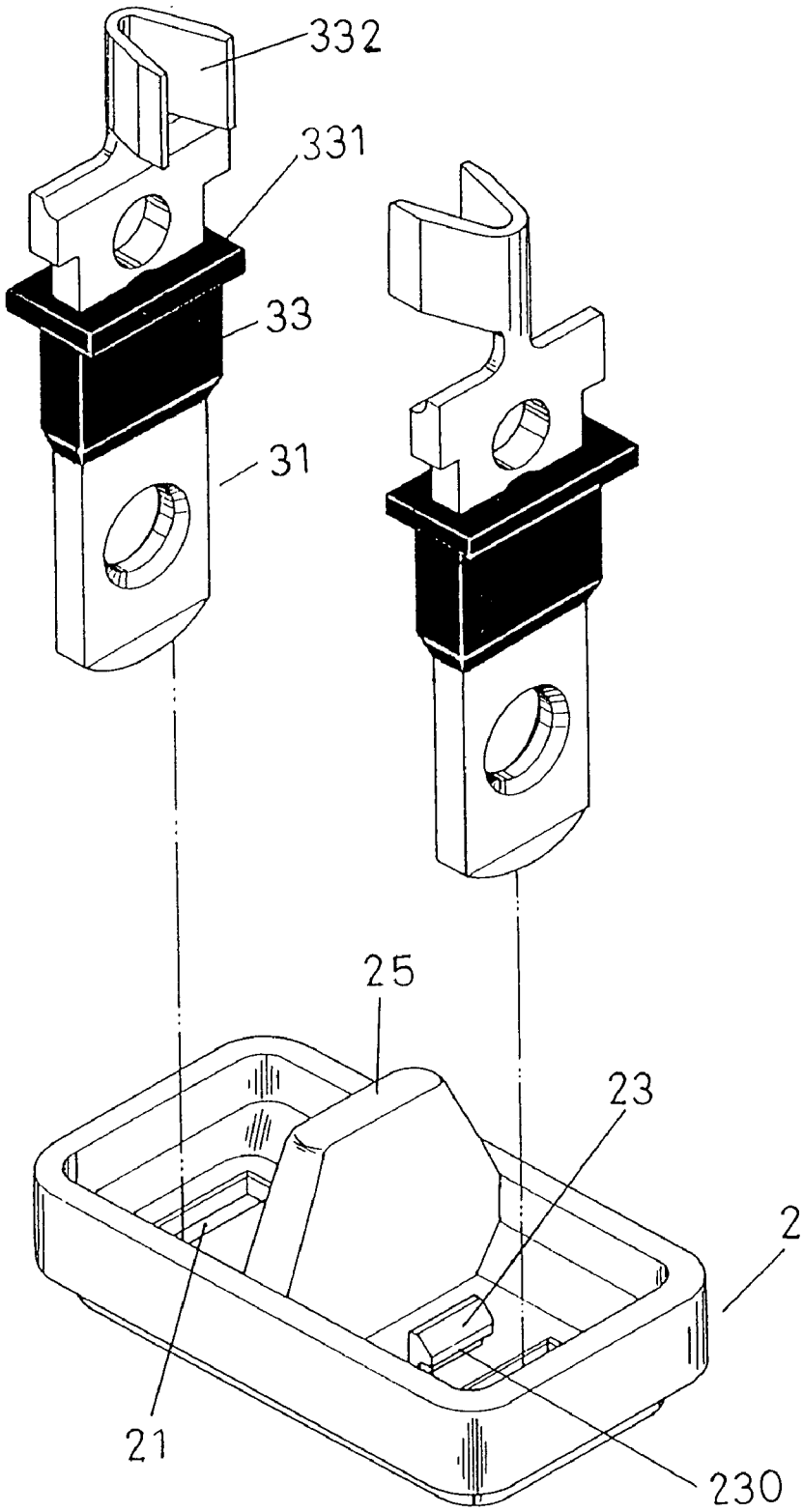
FIG. 2 is an exploded perspective view of a first embodiment of a structure for engaging blades with an inner frame of a plug in accordance with the present invention.
Figure 3:
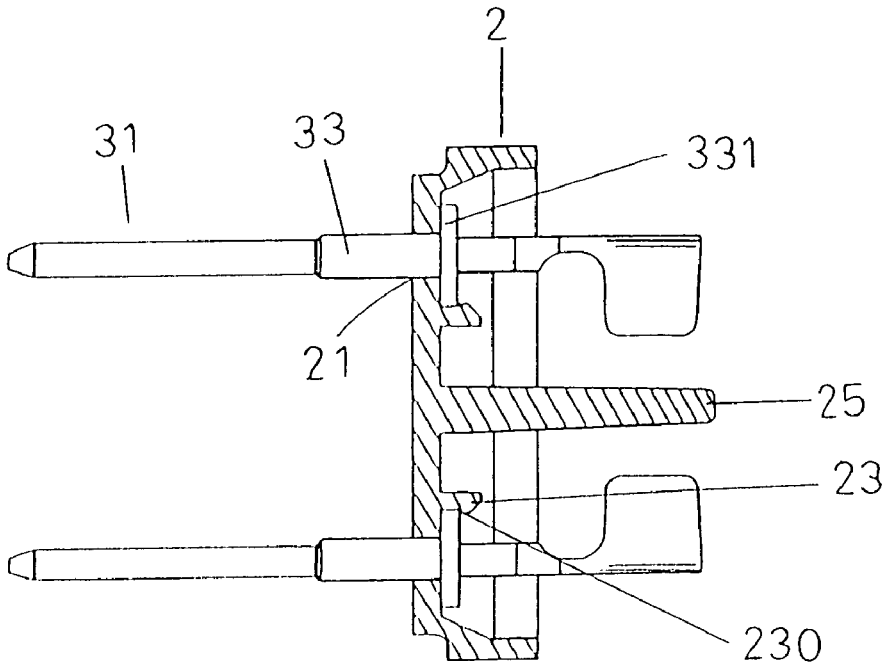
FIG. 3 is a sectional view of the blades and the inner frame in FIG. 2.
Figure 4:
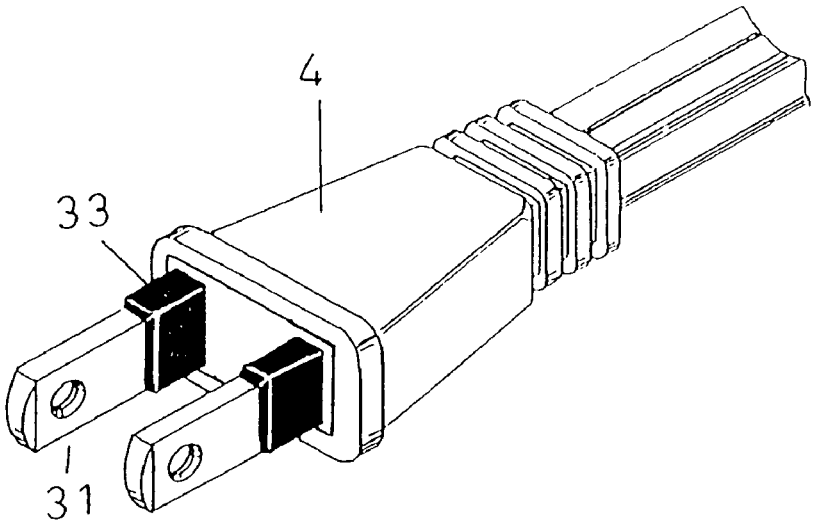
FIG. 4 is a plug made from the blades and the inner frame in FIG. 3.

FIG. 2 is an exploded perspective view of a first embodiment of a structure for engaging blades with an inner frame of a plug in accordance with the present invention. FIG. 3 is a sectional view of the blades and the inner frame in FIG. 2. FIG. 4 is a plug made from the blades and the inner frame in FIG. 3.

The inner fame 2 includes two positioning holes 21 through which two blades 31 (a positive blade and a negative blade) extend, respectively. Two resilient hook members 23 are provided on the inner frame 2 and respectively located adjacent to the positioning holes 21 of the inner frame 2. Further, a separation wall 25 is formed between the positioning holes 21.

Each blade 31 includes an insulating layer 33 formed on a rear section thereof. The insulating layer 33 is made of plastics and formed on the rear section of the blade 31 by injection molding. The insulating layer 33 further includes a flange 331 on a rear end thereof.

Referring to FIG. 3, when the respective blade 31 is disposed in the inner frame 2 and extends through the respective positioning hole 21 of the inner frame 2, the respective resilient hook member 23 bends away from the respective blade 31 and then returns to its original position after the flange 331 of the insulating layer 33 of the respective blade 31 has passed through a hook end 230 of the respective resilient hook member 23. The respective blade 31 is thus retained in place, as the insulating layer 33 of the respective blade 31 is reliably positioned by the respective resilient hook member 23, best shown in FIG. 3. Next, the inner frame 2 together with the blades 31 are placed into a mold for forming a housing 4 by means of injection molding, thereby providing a plug with two blades, as shown in FIG. 4. It is noted that formation of the housing 4 is performed after clamping of an end of a respective wire in a wire-receiving groove 332 (FIG. 2) of the respective blade 31. Further, provision of the separation wall 25 between the positioning holes 21 of the inner frame 2 eliminates the risk of short circuit resulting from a contact between the blades 31 when in a conductive state.

Figure 5:
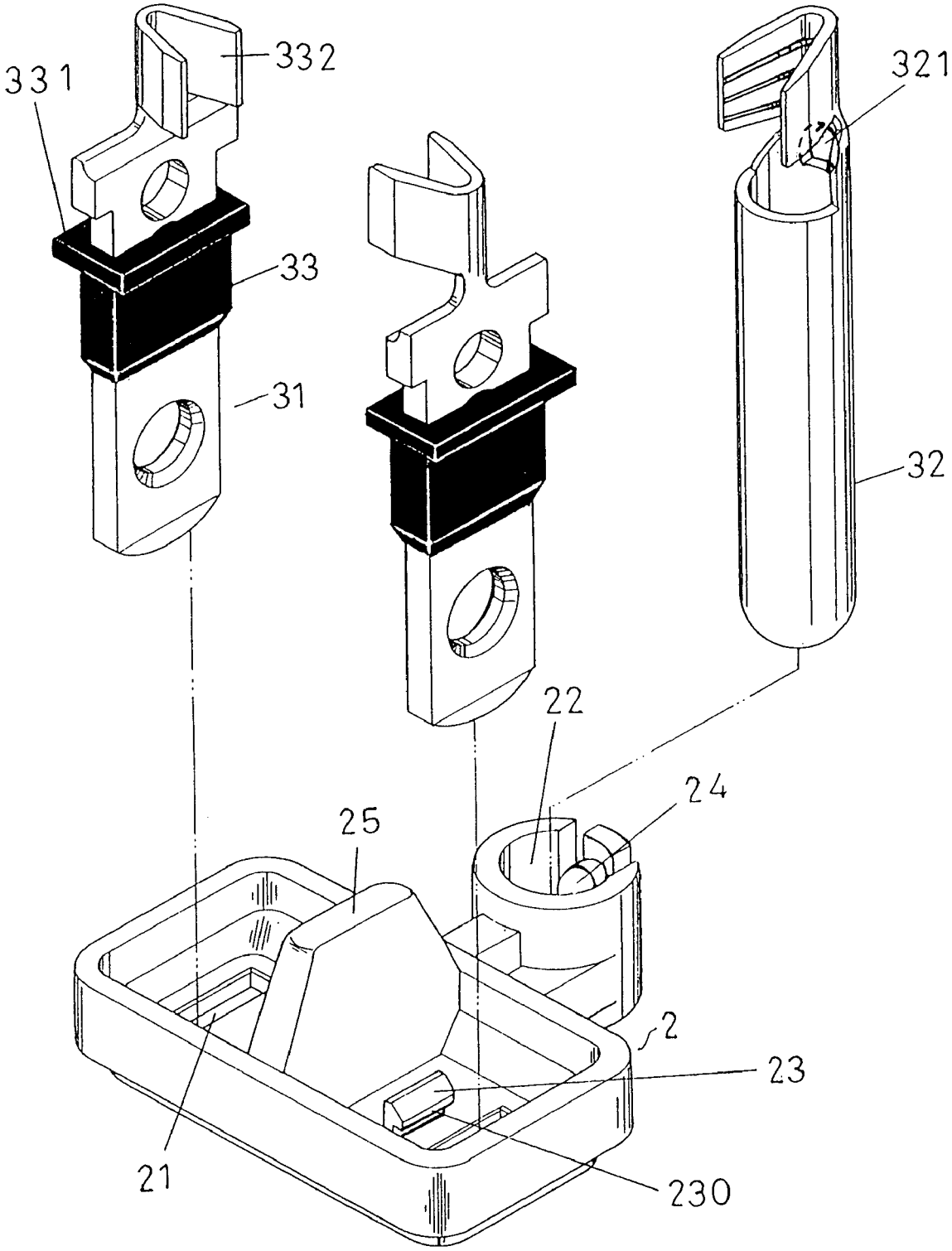
FIG. 5 is an exploded perspective view of a modified embodiment of the structure for engaging blades with an inner frame of a plug in accordance with the present invention.
Figure 7:
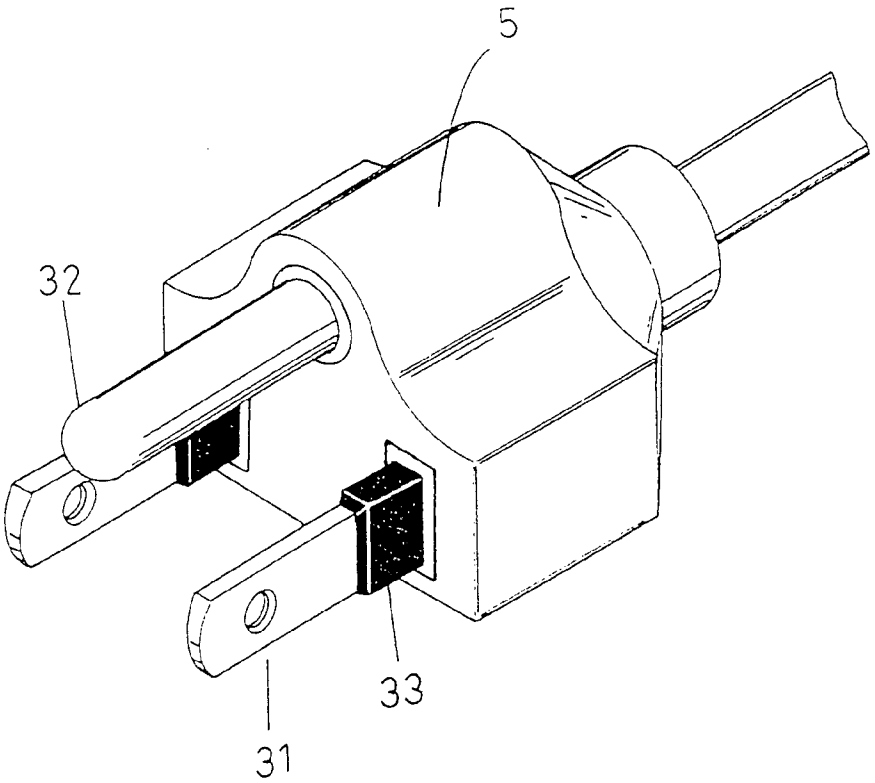
FIG. 7 is a plug made from the blades and the inner frame in FIG. 6.
Figure 6:
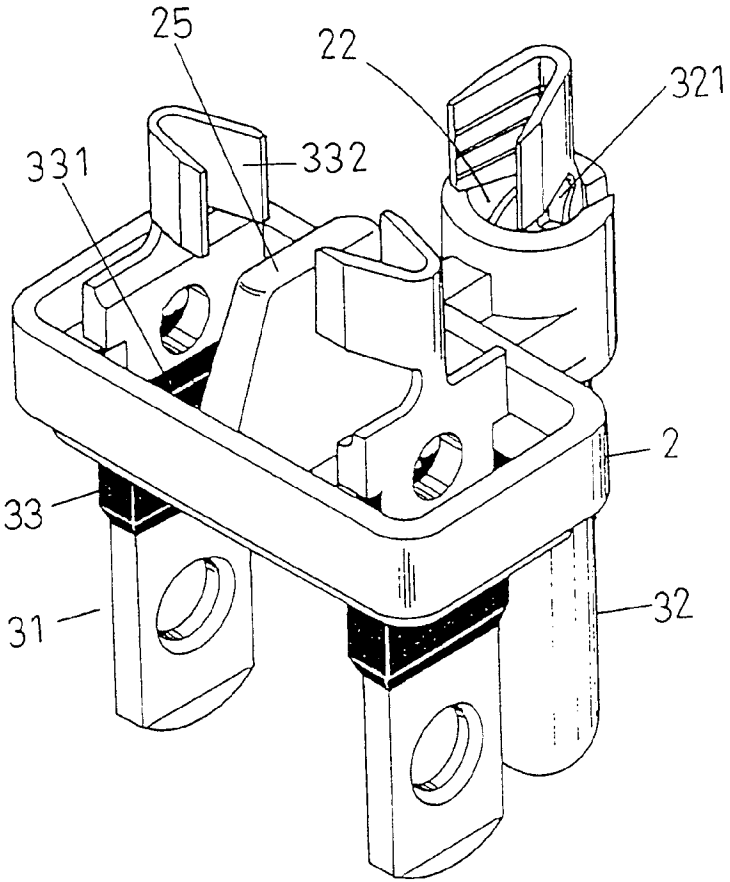
FIG. 6 is a perspective view of the blades and the inner frame in FIG. 5.

FIG. 5 is an exploded perspective view of a modified embodiment of the structure for engaging blades with an inner frame of a plug in accordance with the present invention. FIG. 6 is a perspective view of the blades and the inner frame in FIG. 5. FIG. 7 is a plug made from the blades and the inner frame in FIG. 6.

In this embodiment, in addition to the two positioning holes 21, the inner frame 2 includes a positioning hole 22 through which an additional blade 32 (a grounding prong or blade) extends. Further, an additional resilient hook member 24 is provided on the inner frame 2 and located adjacent to the positioning hole 22 of the inner frame 2.

The grounding blade 32 includes an engaging hole 321 for engaging with the resilient hook member 24 of the inner frame 2 when the grounding blade 32 is disposed in the inner frame 2.

Similar to the above embodiment, each blade 31 includes an insulating layer 33 formed on a rear section thereof. The insulating layer 33 is made of plastics and formed on the rear section of the blade 31 by injection molding. The insulating layer 33 further includes a flange 331 on a rear end thereof.

Formation of a housing 5 of the plug is substantially the same as that of the first embodiment.

Figure 8:
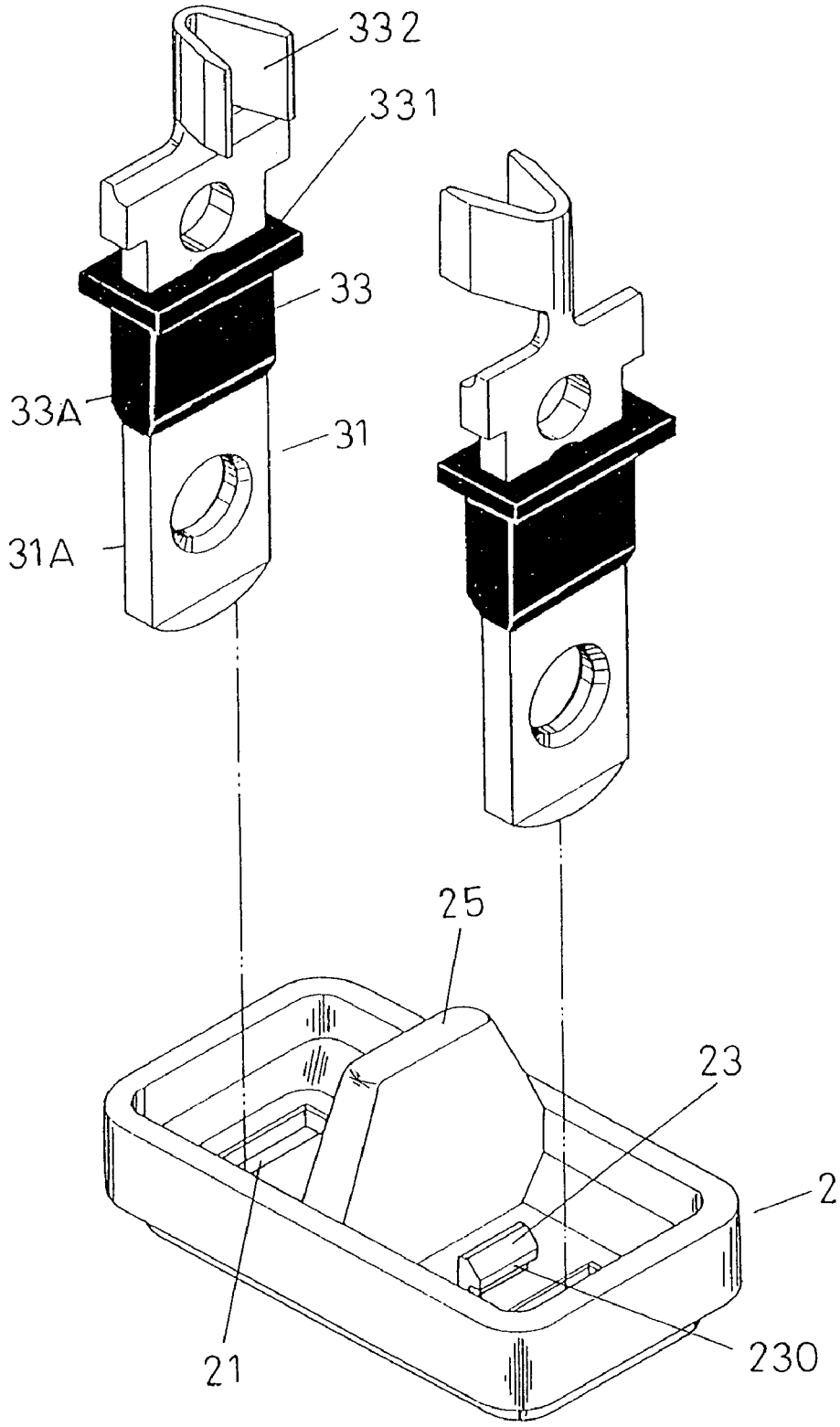
FIG. 8 is an exploded perspective view of another modified embodiment of the structure for engaging blades with an inner frame of a plug in accordance with the present invention.
Figure 9:
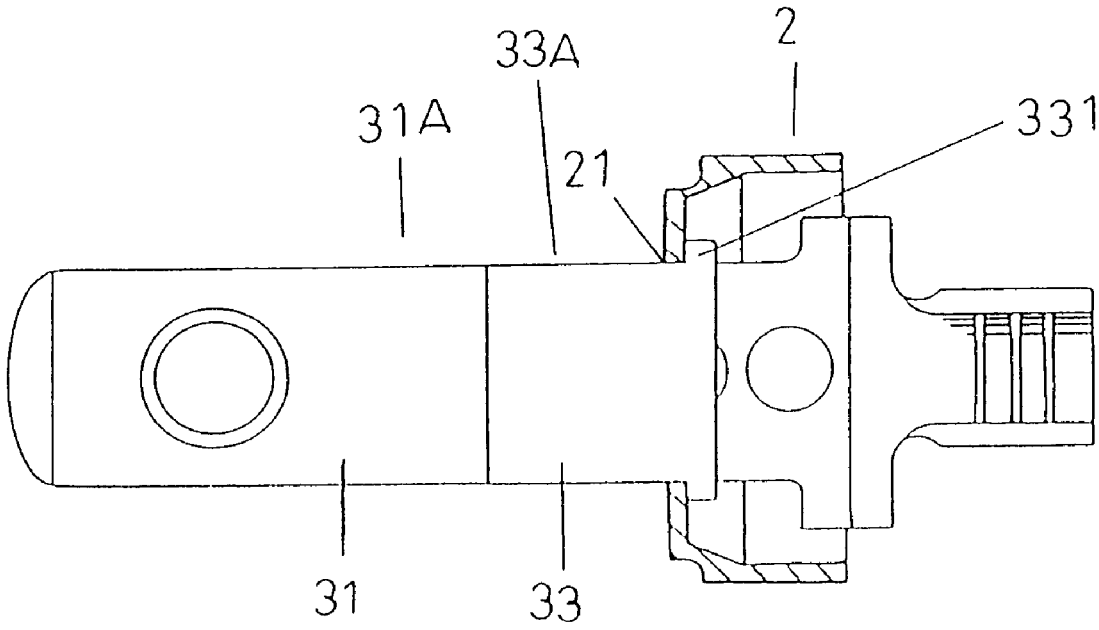
FIG. 9 is a sectional view of the blades and the inner frame in FIG. 8.
Figure 10:
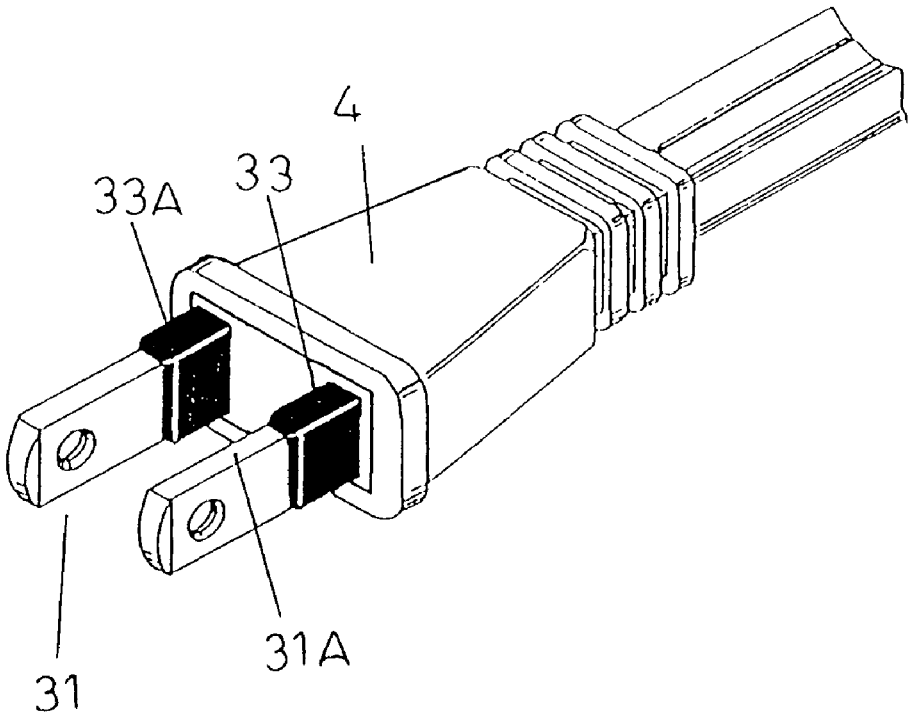
FIG. 10 is a plug made from the blades and the inner frame in FIG. 9.

FIG. 8 is an exploded perspective view of another modified embodiment of the structure for engaging blades with an inner frame of a plug in accordance with the present invention FIG. 9 is a sectional view of the blades and the inner frame in FIG. 8. FIG. 10 is a plug made from the blades and the inner frame in FIG. 9.

The only difference between this embodiment and the embodiment of FIGS. 2 through 4 is that the insulating layer 33 of the respective blade 31 includes two opposite sides 33A that are flush with two lateral sides of the respective blade 31.

Figure 11:
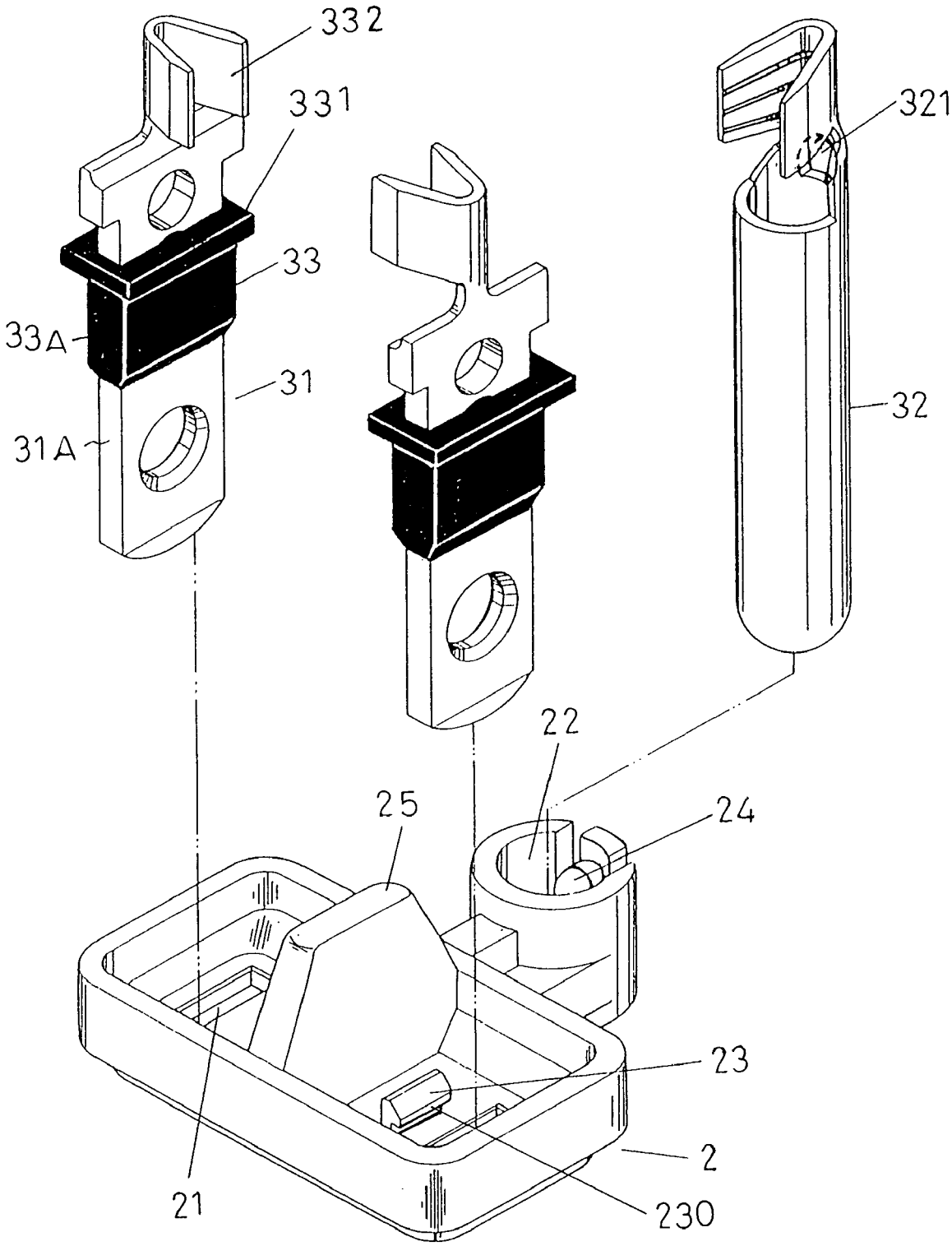
FIG. 11 is an exploded perspective view of a further modified embodiment of the structure for engaging blades with an inner frame of a plug in accordance with the present invention.
Figure 13:
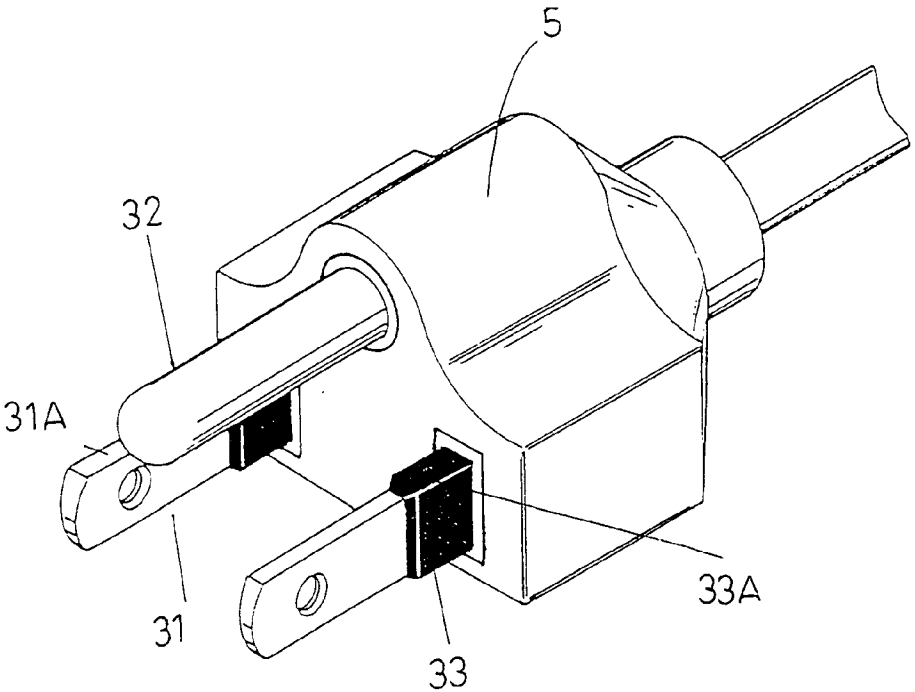
FIG. 13 is a plug made from the blades and the inner frame in FIG. 12.
Figure 12:
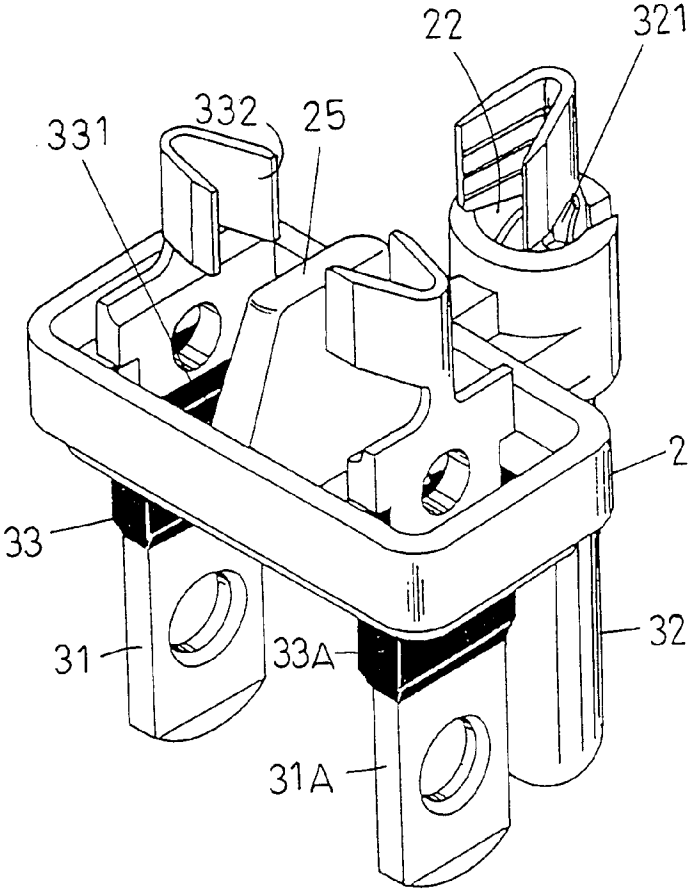
FIG. 12 is a perspective view of the blades and the inner frame in FIG. 11.

FIG. 11 is an exploded perspective view of a further modified embodiment of the structure for engaging blades with an inner frame of a plug in accordance with the present invention. FIG. 12 is a perspective view of the blades and the inner frame in FIG. 11. FIG. 13 is a plug made from the blades and the inner frame in FIG. 12.

The only difference between this embodiment and the embodiment of FIGS. 5 through 7 is that the insulating layer 33 of the respective blade 31 includes two opposite sides 33A that are flush with two lateral sides of the respective blade 31.

Figure 14:
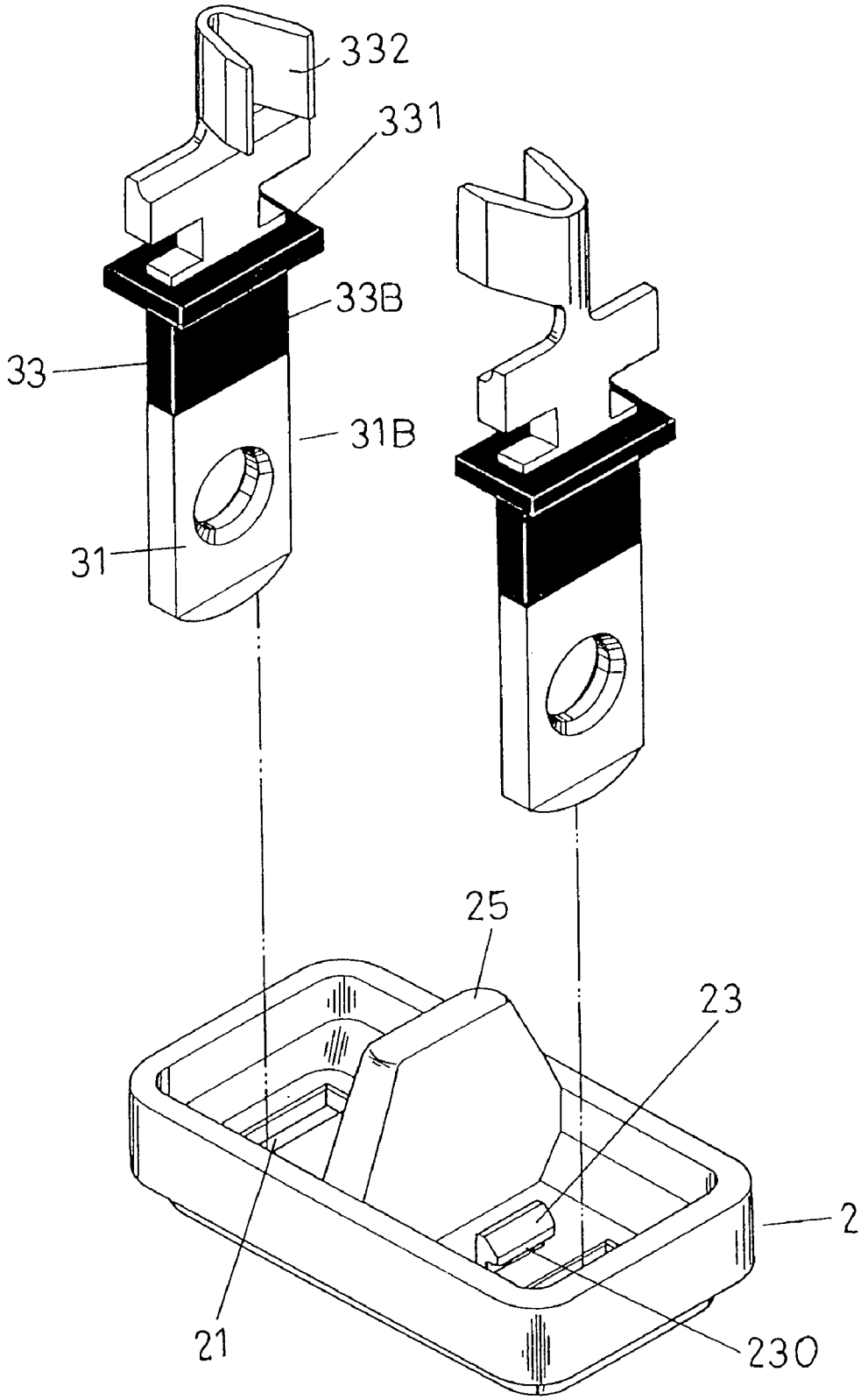
FIG. 14 is an exploded perspective view of still another modified embodiment of the structure for engaging blades with an inner frame of a plug in accordance with the present invention.
Figure 15:
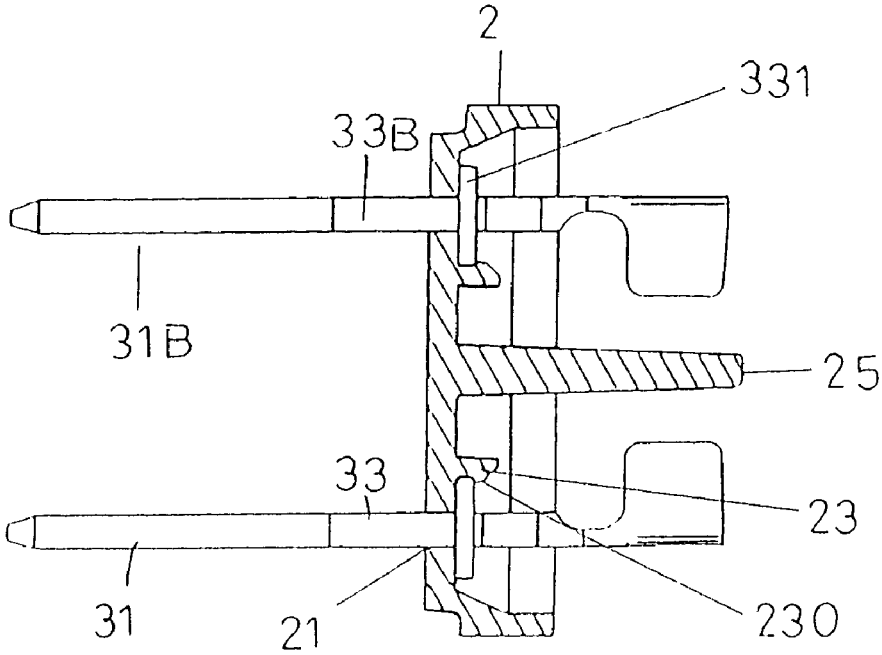
FIG. 15 is a sectional view of the blades and the inner frame in FIG. 14.
Figure 16:
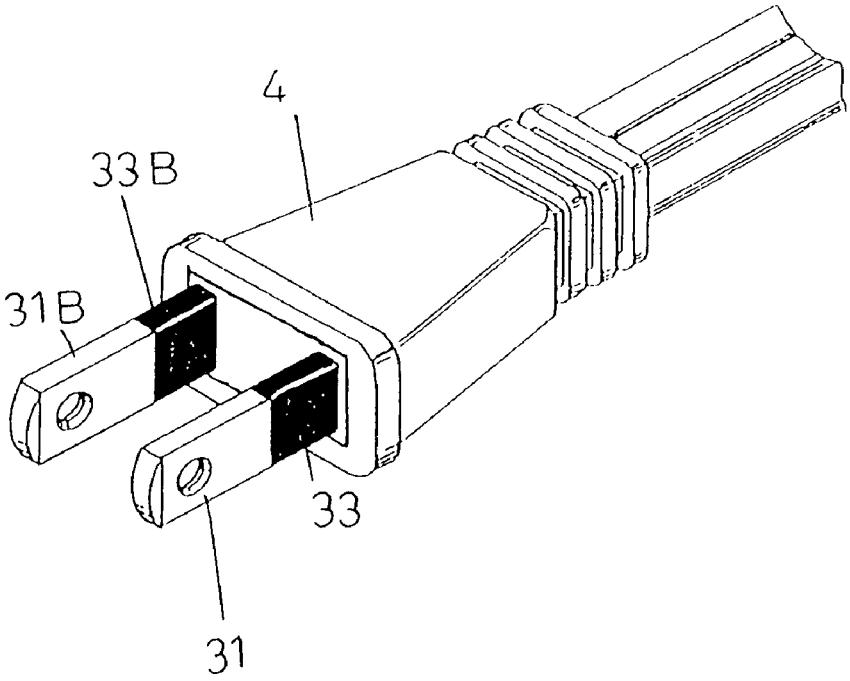
FIG. 16 is a plug made from the blades and the inner frame in FIG. 15.

FIG. 14 is an exploded perspective view of still another modified embodiment of the structure for engaging blades with an inner flame of a plug in accordance with the present invention. FIG. 15 is a sectional view of the blades and the inner frame in FIG. 14. FIG. 16 is a plug made from the blades and the inner frame in FIG. 15.

The only difference between this embodiment and the embodiment of FIGS. 2 through 4 is that the insulating layer 33 of the respective blade 31 includes four sides 33B that are respectively flush with four sides of the respective blade 31.

Figure 17:
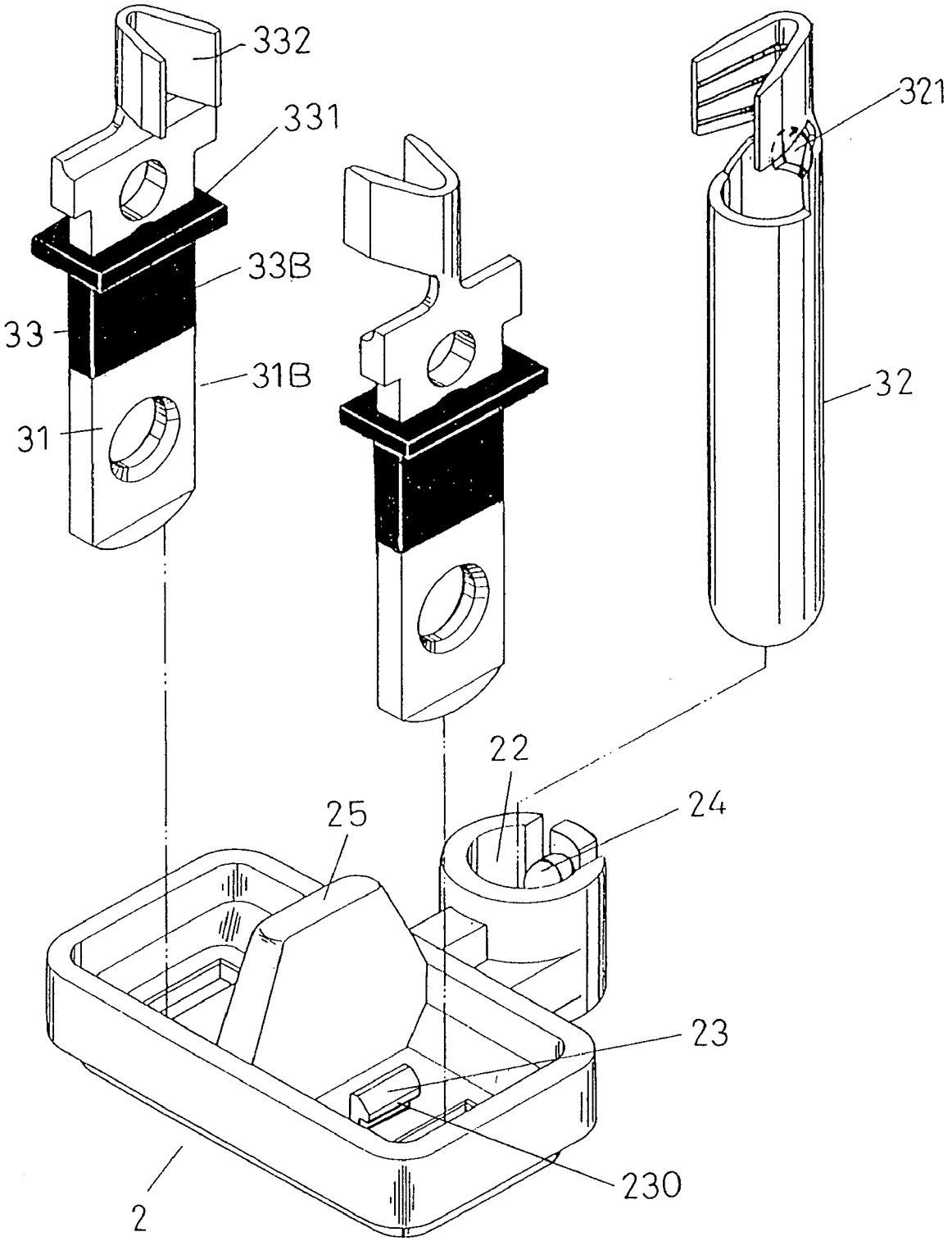
FIG. 17 is an exploded perspective view of yet another modified embodiment of the structure for engaging blades with an inner frame of a plug in accordance with the present invention.
Figure 19:
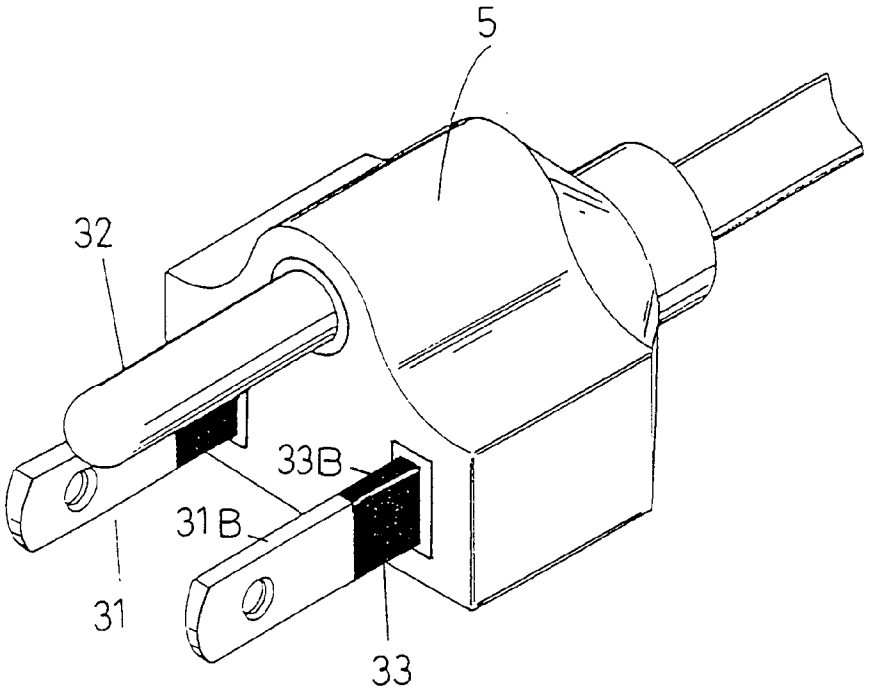
FIG. 19 is a plug made from the blades and the inner frame in FIG. 18.
Figure 18:
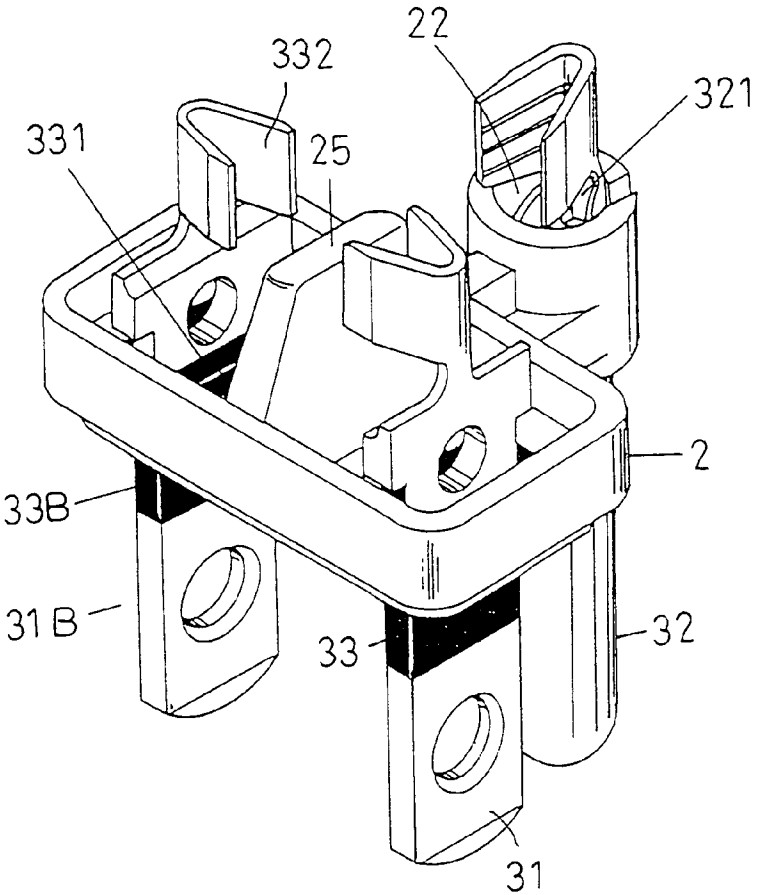
FIG. 18 is a perspective view of the blades and the inner fame in FIG. 17.

FIG. 17 is an exploded perspective view of yet another modified embodiment of the structure for engaging blades with an inner fire of a plug in accordance with the present invention. FIG. 18 is a perspective view of the blades and the inner frame in FIG. 17. FIG. 19 is a plug made from the blades and the inner frame in FIG. 18.

The only difference between this embodiment and the embodiment of FIGS. 5 through 7 is that the insulating layer 33 of the respective blade 31 includes four sides 33B that are respectively flush with four sides of the respective blade 31.

Figure 20:
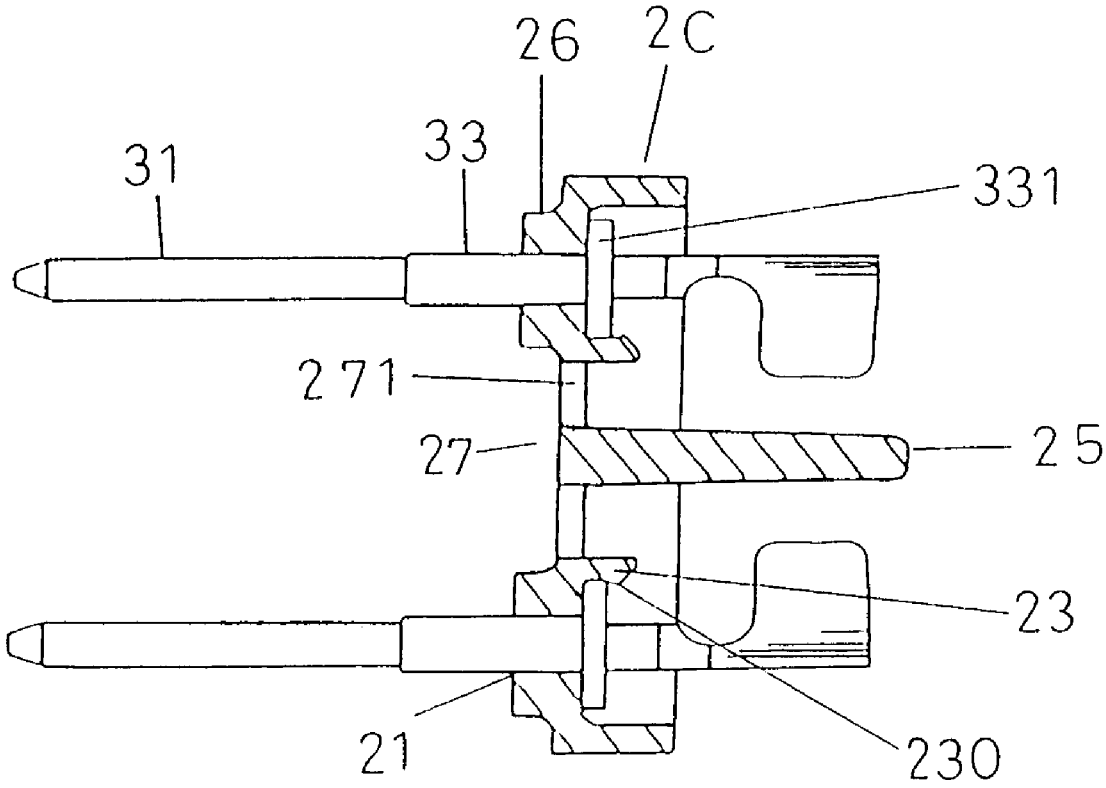
FIG. 20 is a sectional view similar to FIG. 3, illustrating still another modified embodiment of the structure for engaging blades with an inner frame of a plug in accordance with the present invention.

FIG. 20 is a sectional view similar to FIG. 3, illustrating still another modified embodiment of the structure for engaging blades with an inner frame of a plug in accordance with the present invention. In this embodiment, the inner frame 2C includes a protruded portion 26, thereby forming a recessed portion 27 in an outer side of the inner frame (now designated by 2C). The inner frame 2C has a plurality of through-holes 271 (preferably two rectangular through-holes in this embodiment) extending through a bottom wall of the recessed portion 27 and thus communicating with the recessed portion 27. The through-holes 271 provide a passage through which air passes during the injection molding procedure for forming the housing 4, 5 of the plug. Further, the molten plastic material may rapidly fill the recessed portion 27 via the through-holes 271. After hardening of the plastic material, the bonding strength between the inner frame 2C and the housing 4, 5 of the plug is improved.

Conclusively, the blades 31 and 32 are reliably positioned when they are disposed in the inner frame 2, 2C through provision of the flange 331 of the insulating layer 33 of the respective blade 31, the engaging hole 321 of the blade 32, and the resilient hook members 23, 24 of the inner frame 2. Further, provision of the separation wall 25 between the positioning holes 21 of the inner frame 2 eliminates the risk of short circuit resulting from a contact between the blades 31 when in a conductive state. Further, the inner frame 2C may include a recessed portion 27 having a plurality of through-holes 271 allowing passage of air during the injection molding procedure for forming a housing 4, 5 of the plug. The through-holes 271 also allow molten plastic material to rapidly fill the recessed portion 27 via the through-holes 271. The bonding strength between the inner frame 2C and the housing 4, 5 of the plug is improved after hardening of the plastic material.

Although the invention has been explained in relation to its preferred embodiment, it is to be understood that many other possible modifications and variations can be made without departing from the scope of the invention as hereinafter claimed.

What is claimed is:

1. A combination of an inner frame and at least two blades for a plug, the combination including:

an inner frame including at least two positioning holes and at least two hook members respectively located adjacent to said at least two positioning holes; and at least two blades each extending through an associated one of said at least two positioning holes of the inner frame, each said blade including a portion engaged with an associated one of said at least two hook members, thereby retaining said at least two blades in the inner frame during formation of a housing of a plug by injection molding, wherein each said blade includes an insulating layer formed on a rear section thereof, the insulating layer including a flange that is engaged with the associated one of said at least two hook members.

2. The combination of an inner frame and at least two blades for a plug as claimed in claim 1, wherein said at least two blades includes a positive blade and a negative blade.

3. The combination of an inner frame and at least two blades for a plug as claimed in claim 2, wherein said at least two blades further include a grounding blade having an engaging hole for engaging with an associated one of said at least two hook members.

4. The combination of an inner frame and at least two blades for a plug as claimed in claim 1, wherein the inner frame further includes a separation wall between said at least two positioning holes.

5. The combination of an inner frame and at least two blades for a plug as claimed in claim 1, wherein the inner frame includes a protruded portion, thereby forming a recessed portion on an outer side of the inner frame, the inner frame including a plurality of through-holes extending through a bottom wall of the recessed portion, molten plastic material for forming the housing of the plug filling the recessed portion via the through-holes of the inner frame.

6. The combination of an inner frame and at least two blades for a plug as claimed in claim 5, wherein the through-holes include two rectangular through-holes.

7. A combination of an inner frame and at least two blades for a plug, the combination including:

an inner frame including a bottom wall having at least two positioning holes formed therethrough, and at least two hook members each projecting from said bottom wall to be deflectively disposed adjacent to one of said at least two positioning holes; and at least two blades each extending through an associated one of said at least two positioning holes of the inner frame, each said blade including a flange portion engaged with an associated one of said at least two hook members, and captured against said bottom wall thereby, said at least two blades being thereby retained in the inner frame during formation of a housing of a plug by injection molding.

8. The combination of an inner frame and at least two blades for a plug as claimed in claim 7, wherein said at least two blades includes a positive blade and a negative blade.

9. The combination of an inner frame and at least two blades for a plug as claimed in claim 8, wherein said at least two blades further include a grounding blade having an engaging hole for engaging with an associated one of said at least two hook members.

10. The combination of an inner frame and at least two blades for a plug as claimed in claim 7, wherein the inner frame further includes a separation wall between said at least two positioning holes.

* * * * *